US009133610B2

(12) United States Patent
Dressel et al.

(10) Patent No.: US 9,133,610 B2
(45) Date of Patent: Sep. 15, 2015

(54) SANITARY TOILET PLUNGER CONTAINMENT SYSTEM

(71) Applicant: Mark Innovations, LLC, Las Vegas, NV (US)

(72) Inventors: Mark C. Dressel, Wayne, PA (US); Nicole K. Dressel, Wayne, PA (US); Gina M. Marku, Las Vegas, NV (US); Nicholas J. Webb, Redding, CA (US)

(73) Assignee: Mark Innovations, LLC, Las Vegas, NV (US)

( * ) Notice: Subject to any disclaimer, the term of this patent is extended or adjusted under 35 U.S.C. 154(b) by 0 days.

(21) Appl. No.: 13/666,130

(22) Filed: Nov. 1, 2012

(65) Prior Publication Data

US 2014/0116901 A1 May 1, 2014

(51) Int. Cl.
*B65D 81/24* (2006.01)
*E03D 9/00* (2006.01)
*A47K 17/00* (2006.01)

(52) U.S. Cl.
CPC .. *E03D 9/00* (2013.01); *A47K 17/00* (2013.01)

(58) Field of Classification Search
CPC ..... B44D 3/125; B44D 3/123; A47K 1/09; B25H 3/006; B65D 73/0064; B65D 81/264; A61B 19/026; A61L 2/00
USPC ..... 206/361, 209, 209.1, 349, 439, 204, 206/207
See application file for complete search history.

(56) References Cited

U.S. PATENT DOCUMENTS

| | | | | | |
|---|---|---|---|---|---|
| 4,211,750 | A * | 7/1980 | Gillespie | 422/123 |
| 5,295,575 | A * | 3/1994 | Gonzalez | 206/204 |
| 5,945,076 | A * | 8/1999 | Leonard et al. | 422/300 |
| 5,960,801 | A * | 10/1999 | Vermooten et al. | 132/308 |
| 5,960,956 | A * | 10/1999 | Langanki et al. | 206/440 |
| 6,038,709 | A * | 3/2000 | Kent | 4/255.05 |
| 6,053,318 | A * | 4/2000 | Petterson | 206/440 |
| 6,383,457 | B1 * | 5/2002 | Brown | 422/300 |
| 6,478,147 | B1 * | 11/2002 | Brander et al. | 206/204 |
| 6,793,882 | B1 * | 9/2004 | Verschuur | 422/6 |
| 7,185,759 | B2 * | 3/2007 | Rich | 206/349 |
| 7,328,793 | B2 * | 2/2008 | Leaphart et al. | 206/349 |
| 7,669,715 | B2 * | 3/2010 | Wang | 206/581 |
| 7,841,029 | B1 * | 11/2010 | Williams | 4/661 |
| 7,861,858 | B2 * | 1/2011 | Wang | 206/349 |
| 2006/0219578 | A1 * | 10/2006 | Owensby | 206/204 |
| 2007/0094779 | A1 * | 5/2007 | Dauphin | 4/255.01 |
| 2008/0156680 | A1 * | 7/2008 | Lai | 206/361 |
| 2008/0197030 | A1 * | 8/2008 | Wang | 206/216 |
| 2013/0180874 | A1 * | 7/2013 | Yang et al. | 206/349 |

* cited by examiner

*Primary Examiner* — Anthony Stashick
*Assistant Examiner* — Jennifer N Zettl
(74) *Attorney, Agent, or Firm* — Harness, Dickey & Pierce, PLC

(57) ABSTRACT

The present invention relates to a toilet plunger containment system including a decorative shell, a selectively removable tray having a disposable disinfectant and a specialized plunger which is housed within the decorative shell during periods of non-use.

8 Claims, 6 Drawing Sheets

SANITARY TOILET PLUNGER CONTAINMENT SYSTEM

FIELD

The present disclosure relates to a toilet plunger containment system and, more particularly, to a sanitary toilet plunger containment system.

BACKGROUND

It is often necessary to employ a toilet plunger to force objects stuck in the drain tube to become dislodged by exerting pressure on the plunger. Unfortunately, this is often a messy task both during the plunging process and afterward when the plunger is removed from the toilet bowl for storage. Controlling the unsanitary nature of using and storing the toilet plunger is therefore highly desirable.

SUMMARY

It is an object of the present invention to provide a sanitary toilet plunger containment system that includes a tray, a disposable disinfectant housed by the tray and, optionally, a specialized plunger and/or a decorative shell for receiving the plunger during periods of non-use.

The shell generally is injection molded component having a lower portion which receives a specially designed tray including a disposable disinfectant and an upper portion which serves to conceal at least a portion of the plunger head. The tray is shaped to seat within the lower portion of the shell and includes a recessed area which contains the disposable disinfectant. During periods of non-use, the plunger head is stored on the tray so as to be in contact with the disposable disinfectant.

The plunger also contributes to the overall cleanliness of the system in that the plunger head and handle portions are uniquely designed to reduce adhesion of the toilet bowl contents to the plunger. As will be described in greater detail below, the plunger head is formed from a low porosity material which is further processed to essentially eliminate the limited porosity. The handle portion is formed from a thermoplastic material which is resistant to adhesion of the toilet bowl contents. By design, the upper portion of the plunger head engages the lower end of the handle shaft to provide a smooth tapered transition which eliminates the edging which often occurs with known toilet plungers.

Under an alternative embodiment of the invention, the upper portion of the decorative shell is eliminated.

Under still another embodiment, the disposable disinfectant and the tray come as a pre-packaged unit whereby upon use, the tray and disinfectant are discarded.

Still other aspects of the invention will be described with reference to the drawings and detailed description provided below.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 8:
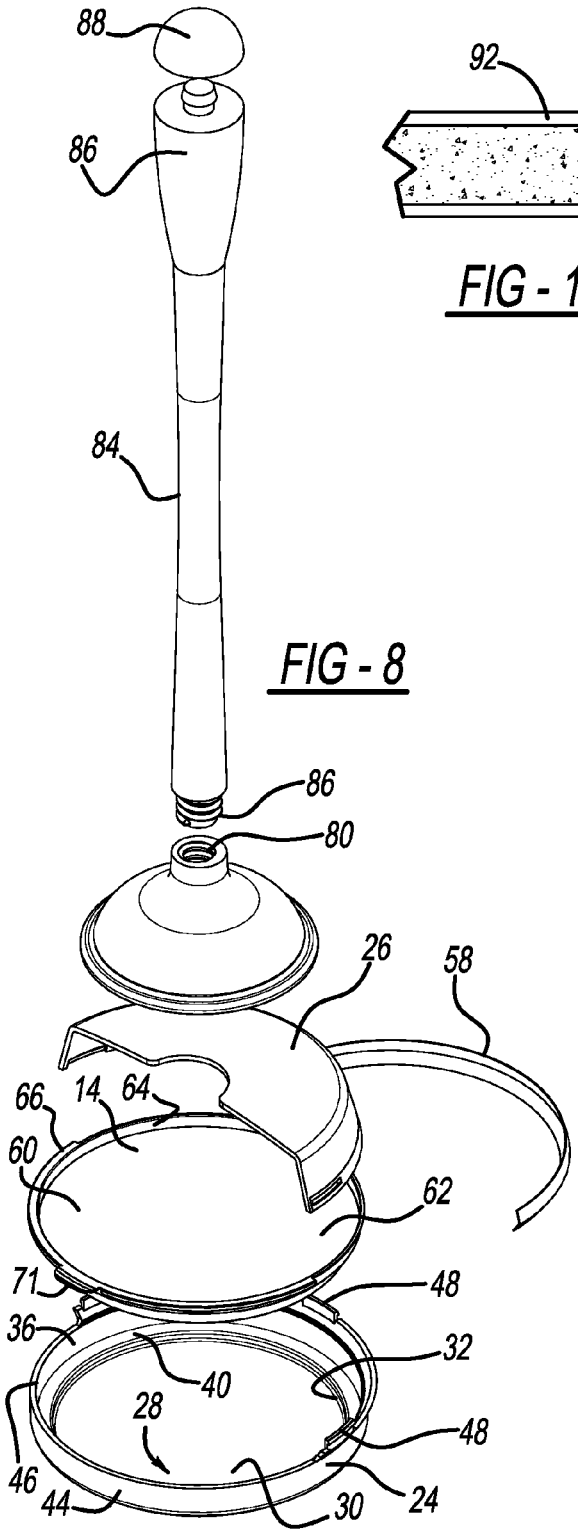
FIG. 8 is an exploded perspective view of a sanitary toilet plunger containment system according to the present invention.

The shell 12, otherwise referred to herein as a housing, is typically formed from a moldable plastic material and is defined by a body 22 including a base 24 and cover 26 as best shown with reference to FIG. 8. The base 24 is in the form of a two tiered bowl wherein the lower tier 28 is defined by a bottom wall 30 and a first circumferential wall 32 and the upper tier 36 extends outwardly and upwardly from the circumferential wall 32. The outwardly projecting portion forms an intervening shelf 40 to assist in retaining the selectively removable tray 14. The upwardly projecting portion forms a second circumferential wall 44 which is larger than first circumferential wall 32 and includes an upper lip 46 having a plurality of spaced apart flanges 48 designed to engage the upper portion 26 of the shell 12 in a snap fit relationship. Optionally, the shell may include an elongated decorative band 58 which snaps over the junction of the base and cover of the housing when the two components are adjoined.

The cover 26, which only partially covers the base 24, includes an open area 56 so as to allow for insertion and removal of the toilet plunger, includes a side wall 50 and a semi-circular top wall 52 which serves as a splash guard. The top wall 52 preferably includes a cut-out area 54 sized to receive a lower portion of the toilet plunger handle.

Figure 1:
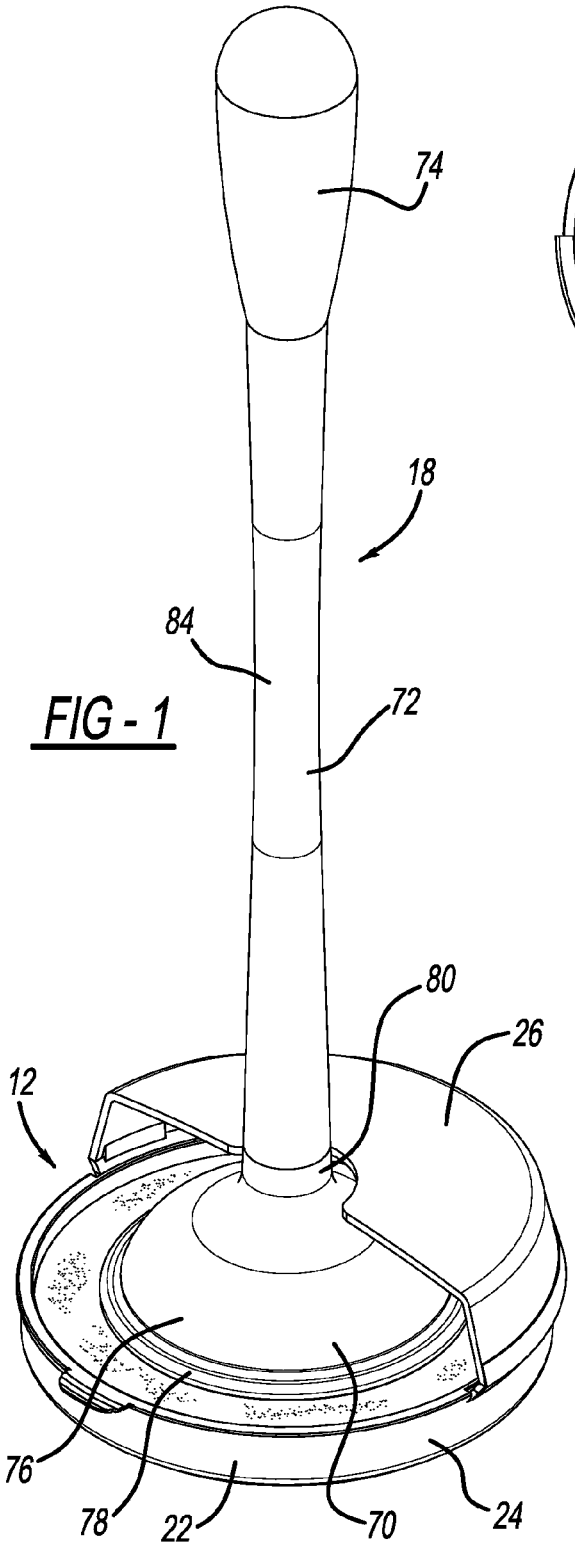
FIG. 1 shows a perspective view of the sanitary toilet plunger containment system of the present invention.
Figure 2:
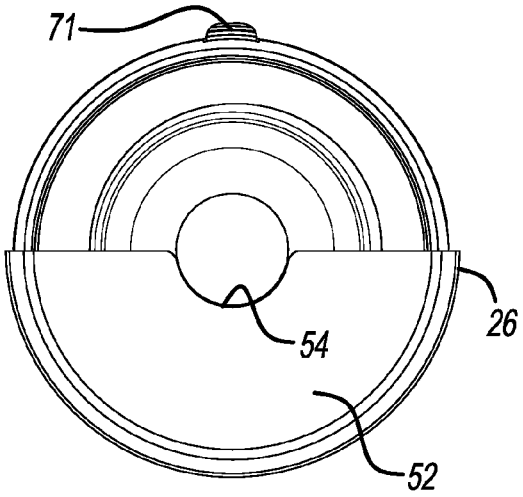
FIG. 2 is a top view of the sanitary toilet plunger containment system.
Figure 3:
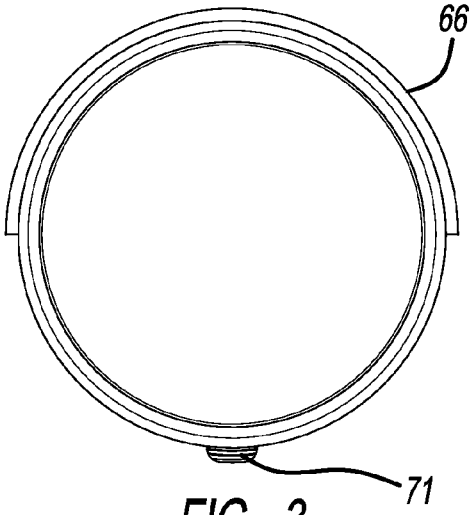
FIG. 3 is a top view of the selectively removable tray of the present invention.
Figure 4:
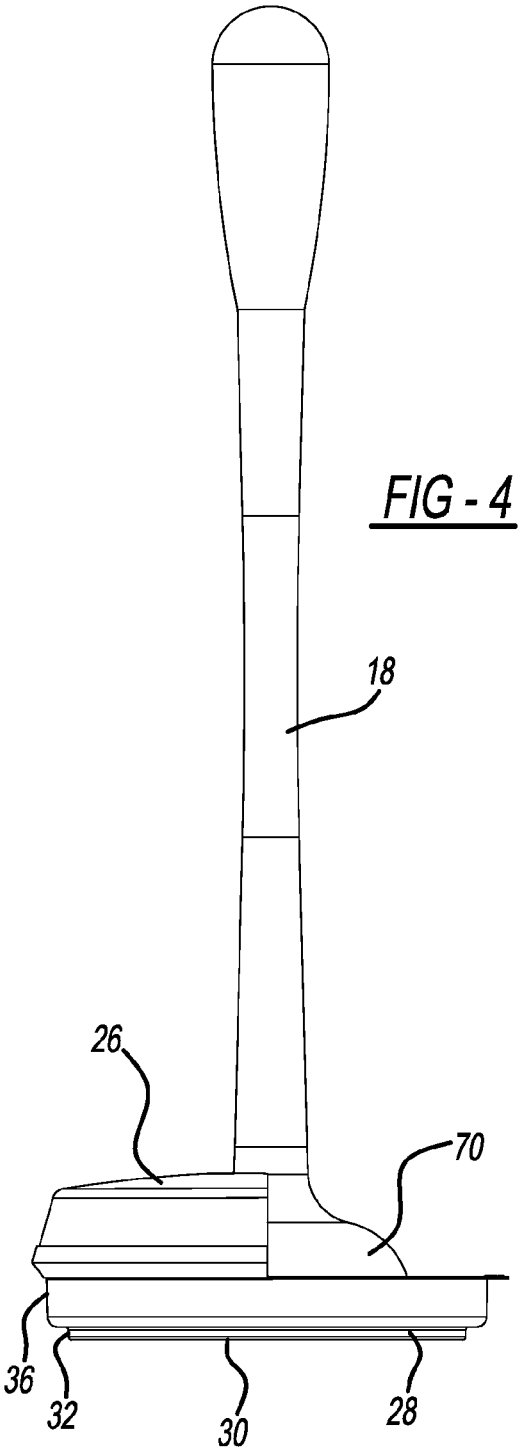
FIG. 4 is a first side view of the sanitary toilet plunger containment system.
Figure 5:
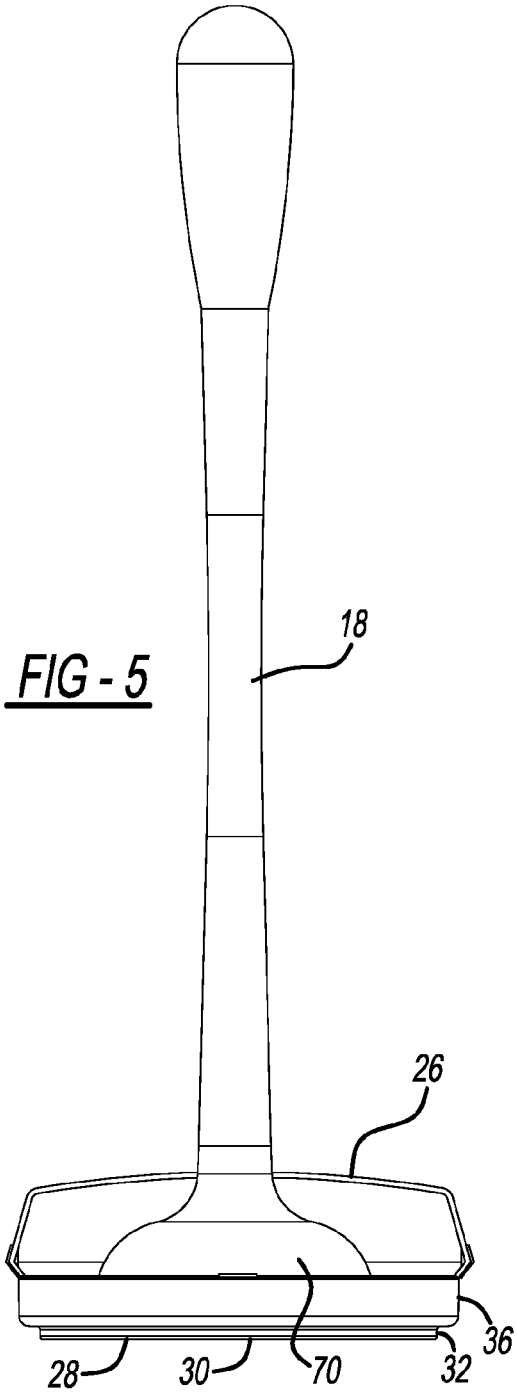
FIG. 5 is a front view of the sanitary toilet plunger containment system.
Figure 6:
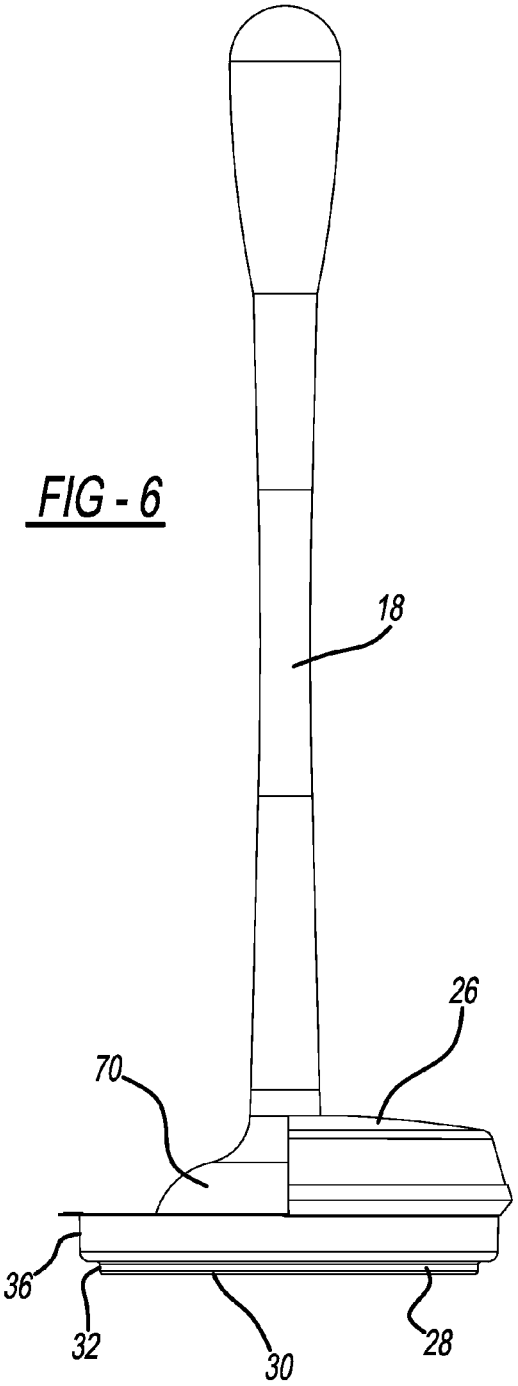
FIG. 6 is a second side view of the sanitary toilet plunger containment system.
Figure 7:
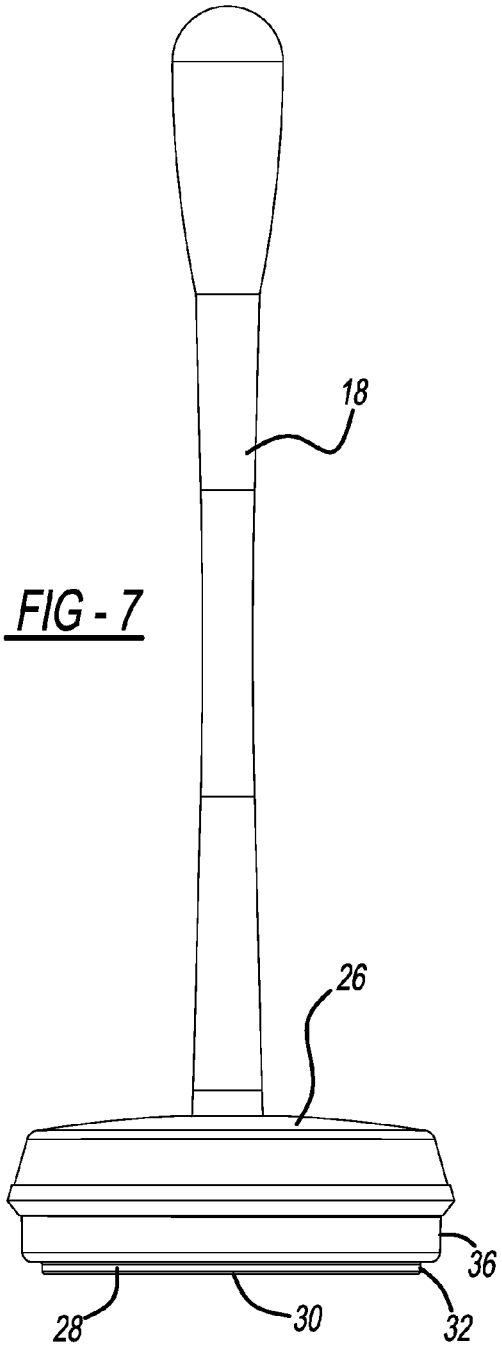
FIG. 7 is a rear view of the sanitary toilet plunger containment system.

The selectively removable tray 14, as best shown in FIGS. 3 and 8, is defined by a body 60 including a bottom wall 62, a side wall 64, and a lip 66 extends outwardly from the side wall. The lip 66 seats over the upper lip 46 of the housing. The lip 66 is generally hemispherical and terminates at the edge of upper portion of the housing when the tray is positioned within the shell. Ideally, the body of the tray 14 is sized to fit securely within the body of the housing 12. Extending outwardly from the lip 66 is gripping tab 71 which facilitates insertion and removal of the tray from the housing.

The tray itself is designed to host a disposable, moisture absorptive material which includes a disinfectant component. This disposable disinfectant can be formed from a variety of moisture absorptive materials including, without limitation, charcoal, cellulosic materials such as wood chips, paper and cardboard or absorbent fibers by way of non-limiting example. The disposable disinfectant should be somewhat hydrophilic and may include disinfectant compositions, deodorizing additives and/or scented materials such as pine or floral scents, among others.

Figure 10:
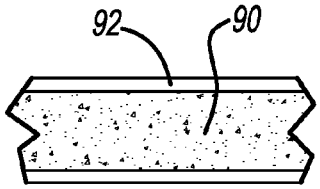
FIG. 10 is a sectional view taken along line 10-10 of FIG. 9 showing a disposable disinfectant component useful according to the teachings of the present invention.

As should be appreciated, the moisture absorptive material 90 should be capable of being treated with disinfectants and deodorants in liquid, solid or gaseous form, and yet still be sufficiently absorptive after treatment with these types of compositions to consume waste water coming off of the plunger. Preferably, the moisture adaptive material is contained within the tray. A liquid permeable and/or perforated layer 92, is separated from the absorptive material and is sealed to the edge of the tray as shown in FIG. 11A. Alternatively, as shown in FIG. 10, the layer 92 can be adjacent to and serves as a wrapping for the absorptive material. By concealing the absorptive material with layer 92, exposure to the disinfecting composition and the absorptive material when loading or emptying the tray can be minimized. Further, prepackaging the disposable disinfectant facilitates loading and unloading of the composition from the tray as well as ease of storage. As shown in various figures, the packaged absorptive material is ideally sloped to conform to the slope receiving tray.

Under a highly preferred embodiment, the moisture absorptive material 90 will be in the form of replaceable packets that can be sold separately when refills are needed.

As for the plunger 18, the major elements include a suction cup 70, the shaft 72 and the handle 74. The cup 70 includes a body 76, a peripheral lip 78 and a coupling portion 80 extending upwardly from the body. The cup is formed from a material such as 60-90 a durometer silicone, butyl rubber or other liquid injection moldable material or elastomeric thermoplastics which is sufficiently durable and flexible to carry out effective plunging. An added benefit of this type of material is that it has limited porosity and is generally resistant to absorption; that is, toilet matter generally does not stick to it. Under a highly preferred embodiment, the plunger cup will be post treated to substantially eliminate the porosity all together. A high polished diamond lapping process can be employed to eliminate any surface porosity in the plunger head which is molded from a silicone or other low porosity elastomeric or thermoplastic elastomeric material.

The shaft 72 is formed from a sufficiently rigid material to withstand the force applied to the plunger during use. Example materials include nylon 66, ABS, polypropylene and other thermoplastic materials that include Teflon like functions that prevent are reduce adhesion of toilet debris to the structure shaft 72 includes an elongated stem 84 and a coupling member 86 extending from the lower end of the shaft which mates with the coupling portion 80 of the cup. As shown, this coupling arrangement is in the form of a male and female threaded embodiment, but as should be appreciated by those skilled in the art, various mechanical coupling arrangements could be utilized. Further, the male and female aspects could be on either the cup or the shaft as long as effective mating is achieved.

Extending along the upper end 86 of the shaft 72 is an enlarged handle 74. As shown, the upper end has a substantially bulbous shape to enhance the ergonomics of the plunger during use. The handle may also include an end cap 88 which is formed from a material which is particularly useful for ergonomic purposes. Alternatively, the upper end 86 can be over molded with an elastomeric material for comfort.

Figure 9:
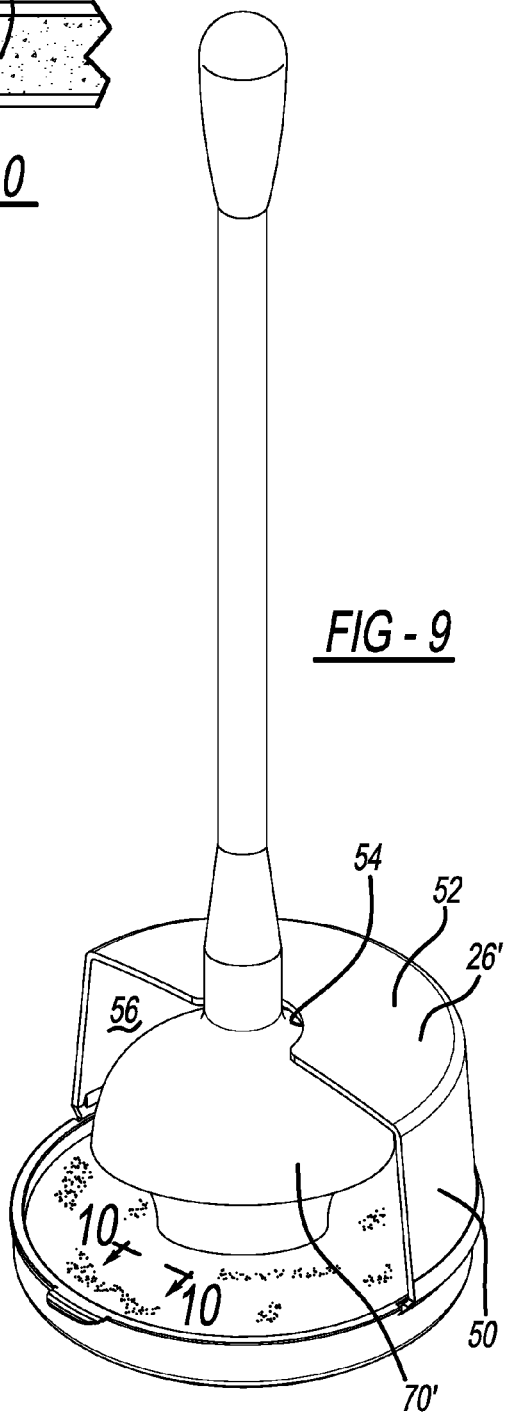
FIG. 9 is a perspective view of a large sized sanitary toilet plunger containment system.

Referring particularly to FIG. 9, an alternative sanitary toilet plunger containment system is shown. As should be readily apparent, this version is particularly suited for lager, industrial type plungers. As such, the upper portion 26' has a larger height dimension as compared to the embodiment shown in FIGS. 1-8. In virtually all other aspects, the containment system is the same. The need for a larger upper portion is that the plunger cup 70' itself is larger than industrial type plungers.

Figure 11:
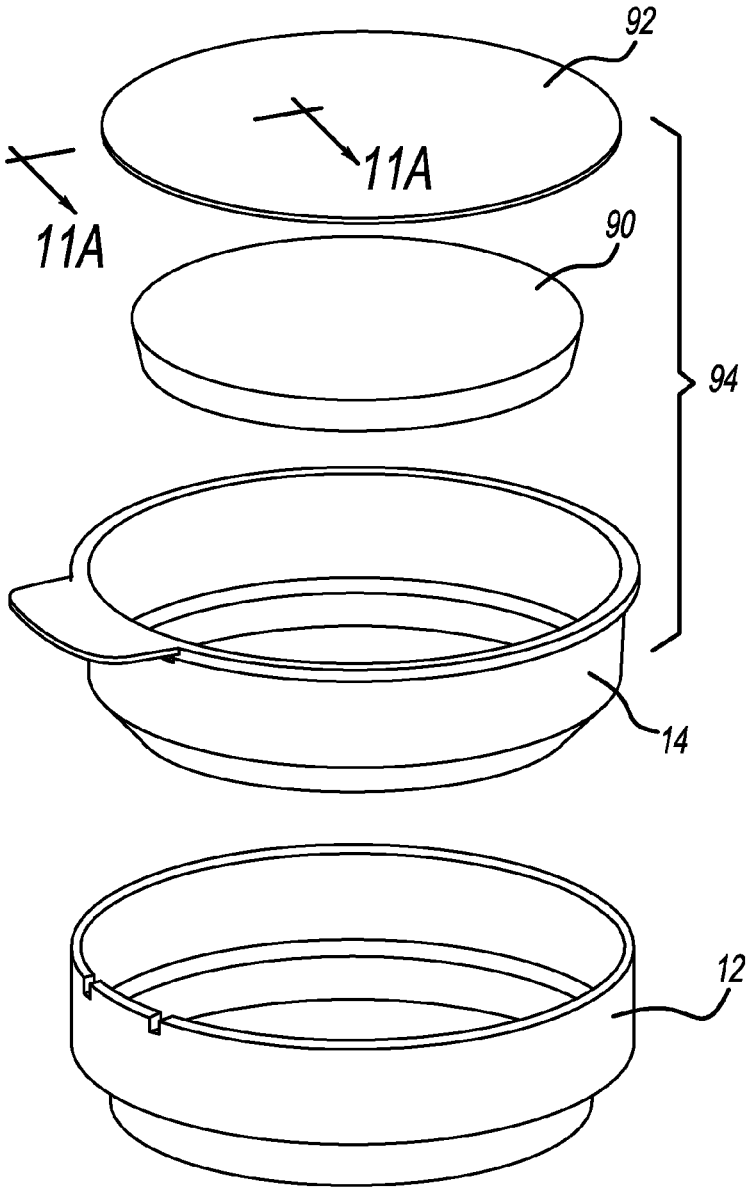
FIG. 11 is an exploded perspective view of an alternative sanitary toilet plunger containment system according to the present invention.
Figure 11A:
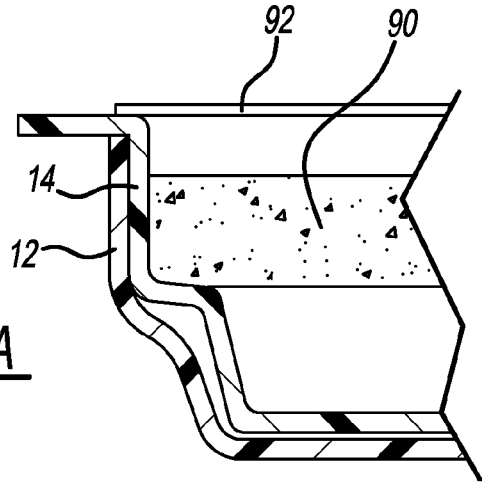
FIG. 11A is a partial sectional view of the sanitary toilet plunger containment system of FIG. 11.

Referring to FIG. 11, an alternative sanitary toilet plunger containment system is shown. Under this embodiment, the moisture absorptive material 90 disposed within the tray and is sealed by a moisture permeable layer attached to the tray. The disposable tray is generally formed from a plastic material, preferably from a recycled feedstock. Again, a moisture absorptive material which is either naturally disinfecting or which can be treated with the appropriate disinfectants and deodorizing agents will be employed as previously described. By pre-packaging both the tray, the moisture absorptive material and the moisture permeably layer as an assembly, the construct 94 can be disposed of when necessary and is readily replaceable The packaging (not shown) for the construct would preferably be moisture resistant to preserve the moisture absorbing characteristics of the absorptive material.

Figure 12:
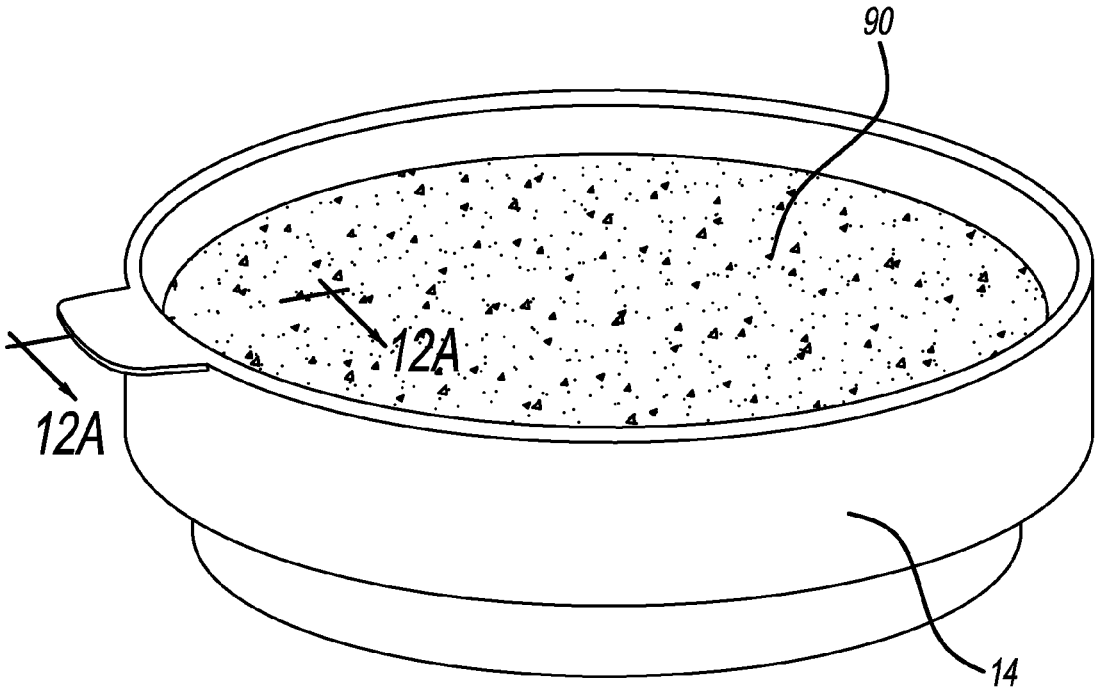
FIG. 12 is an assembled perspective view of a tray and disinfectant component and FIG. 12A is a partial sectional view of the assembly of FIG. 12.
Figure 12A:
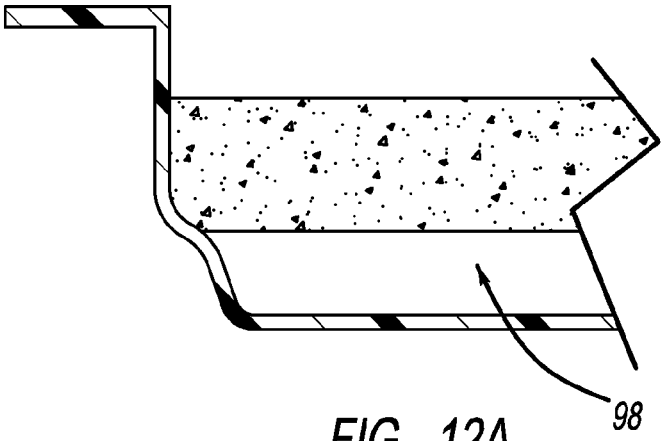

Still another variation of the present invention is shown in FIG. 12. According to this embodiment, the moisture absorptive material is in the form of a wafer or disc positioned within a tray. A space 98 occurs below the absorptive material to capture excess waste water coming off of the plunger if need be. In this embodiment, the disposable disinfectant component is sufficiently rigid to support the plunger when placed thereupon.

The plunger containment systems described herein may be offered commercially as a kit. The kit may include at a minimum, a tray and a moisture absorbing component as described above. The kit may also include a decorative shell and optionally a plunger. Again, once the moisture absorptive component is exhausted, refills could be purchased separately.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A sanitary toilet plunger and containment system kit comprising:

a toilet plunger including a handle and a plunging cup;

a tray including a semi-circular shaped radially extending lip;

a disinfecting component disposed within the tray; and a housing including a base portion having an annular wall which axially supports the radially extending lip of the tray and a cover, said cover including an opening of sufficient size to allow the cup portion of a plunger to be positioned upon the tray in contact with the disinfecting composition during periods of non-use.

2. The kit of claim 1 wherein the disinfecting component is in the form of a moisture absorbing material treated with at least one of a disinfecting or deodorizing agent.

3. The kit of claim 1 wherein the disinfecting component is packaged separately.

4. The kit of claim 1 wherein the moisture absorbing material is selected from the group consisting of activated charcoal, cellulosic materials and fibrous materials.

5. The kit of claim 1 wherein the tray includes an outwardly projecting gripping tab.

6. The toilet plunger of claim 1, wherein the tray includes a substantially hemispherical lip portion seated on said base.

7. The toilet plunger of claim 1, wherein the cover includes a substantially hemispherical side wall seated on said base.

8. A sanitary toilet plunger containment system for holding a plunger during periods of non-use comprising:

a tray including a radially extending gripping tab;

a disposable disinfecting component for treating human waste positioned within the tray; and a housing including a base portion having an annular wall, the annular wall having a first semi-circular portion and a second semi-circular portion, the first semi-circular portion axially supporting the tray and the second semi-circular portion axially supporting a cover, said cover including an opening of sufficient size to allow the cup portion of a plunger to be positioned upon the tray in contact with the disinfecting composition during periods of non-use.

* * * * *